United States Patent [19]

Orlando et al.

[11] Patent Number: 4,883,386

[45] Date of Patent: Nov. 28, 1989

[54] METHOD AND DEVICE FOR UNDERWATER MODULAR CROSSING CONSTRUCTION

[75] Inventors: Crescenzo Orlando, Sesto San Giovanni; Sandro Zenere, San Donato Milanese; Antonio Butera, Rome; Leonardo Beghetto, Venice, all of Italy

[73] Assignees: Saipem S.p.A., Milan; Snamprogetti S.p.A., Milan; Spea S.p.A., Milan; Tecnomare S.p.A., Venice, all of Italy

[21] Appl. No.: 192,581

[22] Filed: May 11, 1988

[30] Foreign Application Priority Data

May 15, 1987 [IT] Italy ..... 20531 A/87

[51] Int. Cl.[4] ..... E21D 10/14

[52] U.S. Cl. ..... 405/136; 405/132; 405/158

[58] Field of Search ..... 405/134, 135, 136, 137, 405/1, 2, 7; 414/747, 910

[56] References Cited

U.S. PATENT DOCUMENTS

| | | | |
|---|---|---|---|
| 1,522,408 | 1/1925 | Bayard | 414/910 X |
| 2,367,580 | 1/1945 | Hines | 405/1 |
| 3,733,831 | 5/1973 | Sticker, Jr. | 405/134 |
| 3,984,007 | 10/1976 | Birdwell | 414/910 |
| 4,039,087 | 8/1977 | Sandvick, Sr. | 414/747 |

FOREIGN PATENT DOCUMENTS

| | | | |
|---|---|---|---|
| 229467 | 7/1960 | Australia | 414/747 |
| 554150 | 7/1932 | Fed. Rep. of Germany | 405/134 |
| 1756653 | 8/1970 | Fed. Rep. of Germany | 405/7 |
| 2731478 | 1/1978 | Fed. Rep. of Germany | 405/136 |
| 3333857 | 12/1984 | Fed. Rep. of Germany | 405/134 |
| 0641032 | 1/1979 | U.S.S.R. | 405/7 |
| 1331729 | 8/1987 | U.S.S.R. | 405/7 |
| 2016065 | 9/1979 | United Kingdom | 405/136 |

*Primary Examiner*—Dennis L. Taylor
*Assistant Examiner*—Arlen L. Olsen
*Attorney, Agent, or Firm*—Hedman, Gibson, Costigan & Hoare

[57] ABSTRACT

Process for making a modular, underwater, connection of water stretches, wherein the prefabricated modules from different manufacturing yards, freely floating in the water area in front of a floodable basin, are introduced, one at a time, into the basin, through an upper door and, after the basin is emptied, are laid on support saddles. The modules are then aligned and connected with the end of an already installed length, and, after flooding the basin again, are launched by being butt-pushed by means of a driving system, guided by means of thrust roller units.

5 Claims, 8 Drawing Sheets

Fig.11
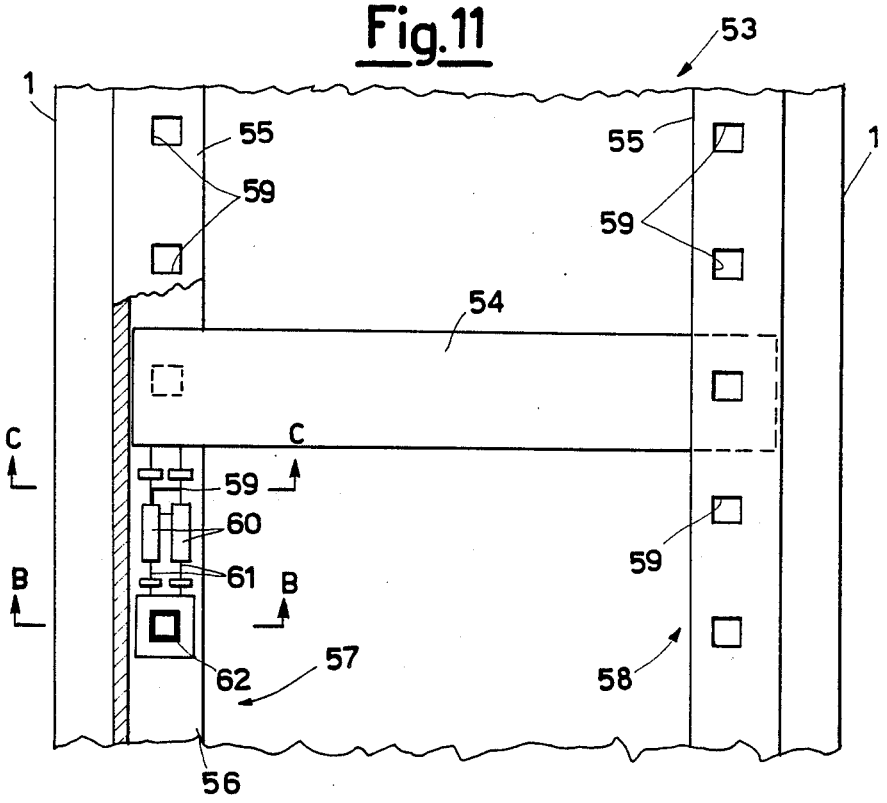
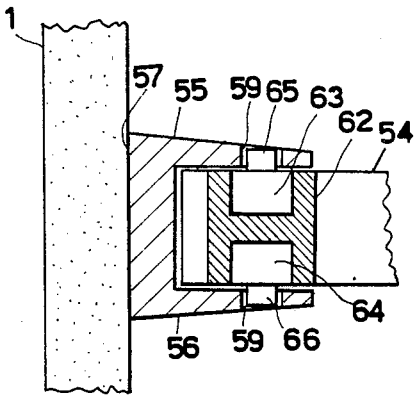
Fig.12
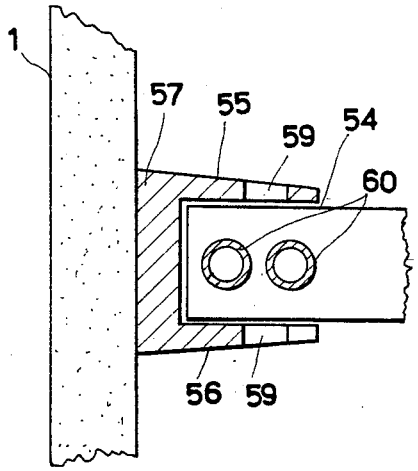
Fig.13

METHOD AND DEVICE FOR UNDERWATER MODULAR CROSSING CONSTRUCTION

BACKGROUND OF THE INVENTION

The present invention relates to a process which, by using prefabricated modules prefabricated at different manufacturing yards, from the assembly point, which is flooded, makes it possible to simplify, speed up and make a modular connection for use by road vehicles, and railway vehicles, pedestrians, an underwater crossing of water stretches.

The invention relates also to some specific outfits for practicing said process.

The process according to the invention essentially consists in butt-connecting, inside a flooded basin, large prefabricated modules, with a length on the order of 150 meters. These are introduced into the basin under free floating conditions, and are progressively pushed across beneath the stretch of water until the underwater crossing is complete.

From the prior art, different kinds of modular practicable crossings of water stretches are already known, which essentially consist of floating structures, or of structures laid on the water bed.

The structures of the first type have navigational drawbacks, and those of the second type are practically unrealizable beyond a certain depth and with irregular water beds. Also, in both cases, a yard always has to be established, which moves along the lay-out of the work, with inherent complications.

Modular processes are also known, which are carried out in a fixed yard inside a floodable basin, or situated on the bank adjacent to the basin, but these realizations also show considerable drawbacks.

Fixing a yard inside the basin wastes considerable time and money because the sequential steps of assemblage such as prefabrication of the module, ageing, or drying, of the same module, and dismantling the yard before launching the module, have to be repeated after each module is launched.

Fixing a yard on the bank, requires very powerful and expensive lifting means suitable for introducing into the floodable basin the prefabricated modules. Such modules consequently cannot be too large, and, furthermore, they require a long time to be built or to age or dry, during which time the operations of assemblage and launching are interrupted.

SUMMARY OF THE INVENTION

The purpose of the present invention is to obviate the above said drawbacks and to provide a process for building a modular practicable connection independently from the times of prefabrication and ageing or drying of the modules, without limiting the dimensions of the modules or their storage, and, with operations of assemblage (welding and cementation) and launching of the various modules with no interruptions and hence no down times, and with the easy introduction of the modules into the floodable basin, without any need for lifting means.

The above invention is achieved by different modules, which are prefabricated under optimum conditions of time and place at specialized different and distant manufacturing yards and are conveyed, under free-floating conditions, to the water area, ready for use, and are then introduced, one at a time, into the assemblage basin through a purposely provided upper door.

By always having available at least one prefaricated module, the cycles of connection and launching can follow each other without even minimum interruptions. Additionally, the step of introducing a new module into the basin can be overlapped with the step of launching a so-connected module, with a consequent further reduction in required working times. Furthermore, the possibility of using the large specialized yards, equipped for launching big structures, makes prefabricated modules of large dimensions, of lengths of up to 150 meters-i.e., approximately three times longer than those known from the prior art, possible, with a consequent considerable reduction in the number of the weldings necessary for completing the work.

On the other hand, when the basin is emptied, the prefabricated module is supported inside the basin by saddles, the positions of which are adjustable, and which perform the double function of supporting and positioning the module both in the vertical direction and in the axial, transversal and circumferential directions, in order to line it up with the already installed structure. The module is guided, when the basin is flooded, by overturnable thrust roller units, which are brought to act on side wings provided on the prefabricated modules. These make possible the same module to be connected to the already installed structure in an extremely easy and more precise way. Additionally module can be launched more easily and quickly, with consequent fewer wastes in working time.

Summing up, this invention relates to a process for realizing an underwater, modular, practicable connection for the underwater crossing of water stretches. It comprises butt-connecting modules in sequence, inside a floodable assemblage basin, until the bank opposite the bank on which the assembly basin is located is reached. It comprises the sequential steps of introducing into the said flooded basin, through a purposely provided upper door, the prefabricated modules with side wings, coming from different yards and having a length in the order of 150 meters, which are freely floating in the stand-by area adjacent to the same basin. It further comprises the steps of emptying the basin, after closing said upper door, to cause the previously introduced prefabricated module to lie on support saddles which are positionally adjustable on the bed of the basin. The next steps comprise lining up said module with a length of practicable connection which was previously launched, and already installed inside the water stretch. The module is launched through a lower, water-tight sealed door of said basin, and kept in position by a temporarily-blocking apparatus which is inside the basin and resting upon the saddles which are adjustable both in the vertical direction, and in the axial, transversal and circumferential directions the welding, check, and cementing station is lowered to the basin bed by means of a suitable crane, and the module is butt-connected to the already launched length of practicable connection. The welding station is then relifted from the basin bed by means of the cane. The steps further comprise overturning the thrust roller units provided in the basin until they are blocked above said side wings of the prefabricated module, and flooding the same basin, then disengaging said temporarily-blocking apparatus from the already launched length of practicable connection, and opening said lower, water-tight door, and launching the so-connected module. The module is launched by pushing it by means of the driving system provided inside the basin, and guiding it by means and said thrust roller units, of returning said moving system, as well as said support saddles, back to its initial position. The steps further include reengaging the temporarily-blocking apparatus, closing again said water-tight lower basin door, retracting, by overturning, the thrust roller units, re-opening said upper door, and finally repeating the above disclosed cycle, by introducing into the basin the next, free-floating module.

Then, according to a preferred embodiment of the present invention, each of the support saddles which are positionally adjustable comprises a base movable in the axial direction on the bed of the basin, by means of wheels driven by a ratiomotor, and in the transversal direction by means of pairs of hydraulic adjustment cylinders, respectively fastened to both sides of the same base. The pistons of the cylinders cooperate with rigid shoulder and guide structures. They are fastened and supported by the vertically movable base to the bed of the basin, by means of four vertical hydraulic adjustment cylinders. An intermediate structure is provided at its upper end with a transversal saddle-outline, and it comprises a circumferential-sliding surface for an upper saddle-shaped structure which supports the prefabricated module. The upper saddle-shaped structure is circumferentially movable along the saddle-outline by means of hydraulic cylinders which are respectively hinged between the intermediate structure and the upper structure.

A further preferred embodiment of the present invention, has each thrust roller units overturned above the side wings of the prefabricated module. They comprise two small cars respectively hinged to an end of two "L"-shaped levers, the other ends of which are linked to each other by means of a hydraulic thrust cylinder, with said levers being hinged in their middle portion onto the faces, and opposite to each other in their axial directions, to a bearing structure. From the bearing structure an "L"-shaped structure protrudes in the transversal direction, the lower branch of which is hinged to a support integral with the wall of the floodable basin, to make the whole roller unit revolve in the transversal direction from a retracted position to a working position and viceversa. This is effected by means of a gearwheel which, by being mounted to revolve on the other branch of said "L"-structure, and driven by a small motor supported by said other branch, meshes with the rack of a circle-arc-shaped body transversely positioned, and integral with the wall of the floodable basin. The roller unit is blocked in two positions by means of the insertion of a pin between said other branch of the "L"-structure, and said rack body.

Finally, a further preferred embodiment of the present invention is characterized by driving a system for launching the prefabricated module by a transversal thrust beam, the ends of which slidingly enter mutually opposite wings of two longitudinal, double-"L"-shaped guide beams. These are provided with equidistant, mutually opposite holes, which run across the entire length of the floodable basin, each end of the thrust beam being connected with at least one hydraulic, double-effect, thrust cylinder, the piston of which is connected with a block provided with two mutually opposite vertical hydraulic jacks. These are designed for inserting two teeth into said holes of the mutually opposite wings of the longitudinal guide beams.

The invention is further explained by reference to the attached drawings, which depict a preferred form of practical embodiment for illustrative and non-limitative purposes changes may be supplied without deviating from the scope of the present invention.

BRIEF DESCRIPTION OF THE DRAWINGS

In said drawings:

FIG. 11 shows a partially sectional, enlarged-scale view of the driving realized according to the invention;

FIG. 12 shows a sectional view made along the path BB of FIG. 11;

FIG. 13 shows a sectional view taken along the path CC of FIG. 11.

DETAILED DESCRIPTION OF THE INVENTION

Figure 3:
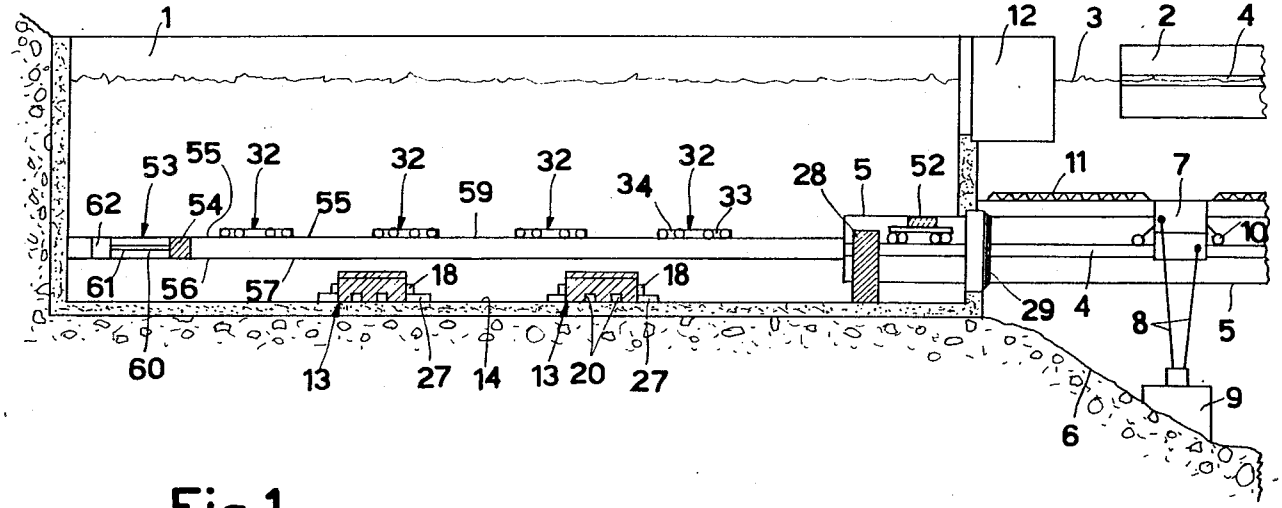
FIG. 3 shows a longitudinal or axial sectional view of the basin, made according to path AA of FIG. 1, and depicts the first step of the process according to the invention.

Referring to the Figures, by the reference numeral 1 a floodable assemblage and launching basin is indicated, which has a depth appropriate to the level of installation of the crossing structure to be built and by the reference numerals 2, 2', 2'', which are modules prefabricated at different specialized yards and are conveyed, by free floating on the water surface 3, to the stand-by area adjacent to the basin, ready for use.

Whenever an underwater path for railway and/or road use in large water stretches has to be built, these modules are of large dimensions, long, with their length being of the order of 150 meters. As examples, the modules are shown in the figures as having a cylindrical configuration, this shape is not an essential condition for the application of the process according to the invention, the only necessary condition is that the modules are provided with two mutually opposite side wings 4 which comprise the way the modules may be guided by thrust roller units. In the same way, the internal preparation, and the system of anchorage of the already installed length of practicable connection 5 does not constitute an essential condition. In particular, in the Figures, it is assumed that the submerged length 5, characterized by an excess of positive thrust, is maintained at its desired level, and is anchored to the bed 6 of the water stretch by means of collars 7 anchored, by means of cables 8, on foundations 9; said collars 7 are provided with roller units 10 suitable for cooperating with the said wings 4, thus allowing the submerged length 5 to slide during the launching operations. These are kept mutually constrained in the longitudinal, viz. axial, direction, by means of the spacers 11.

Figure 4:
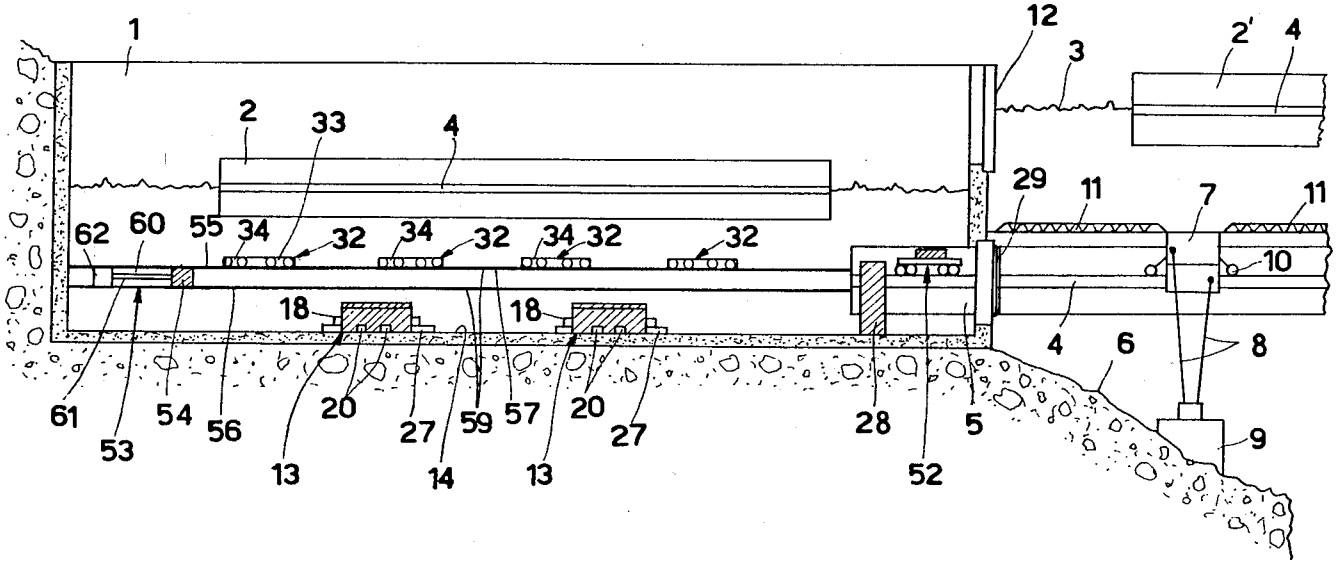
FIGS. 4 to 7 depict the subsequent steps of the process according to the invention.
Figure 8:
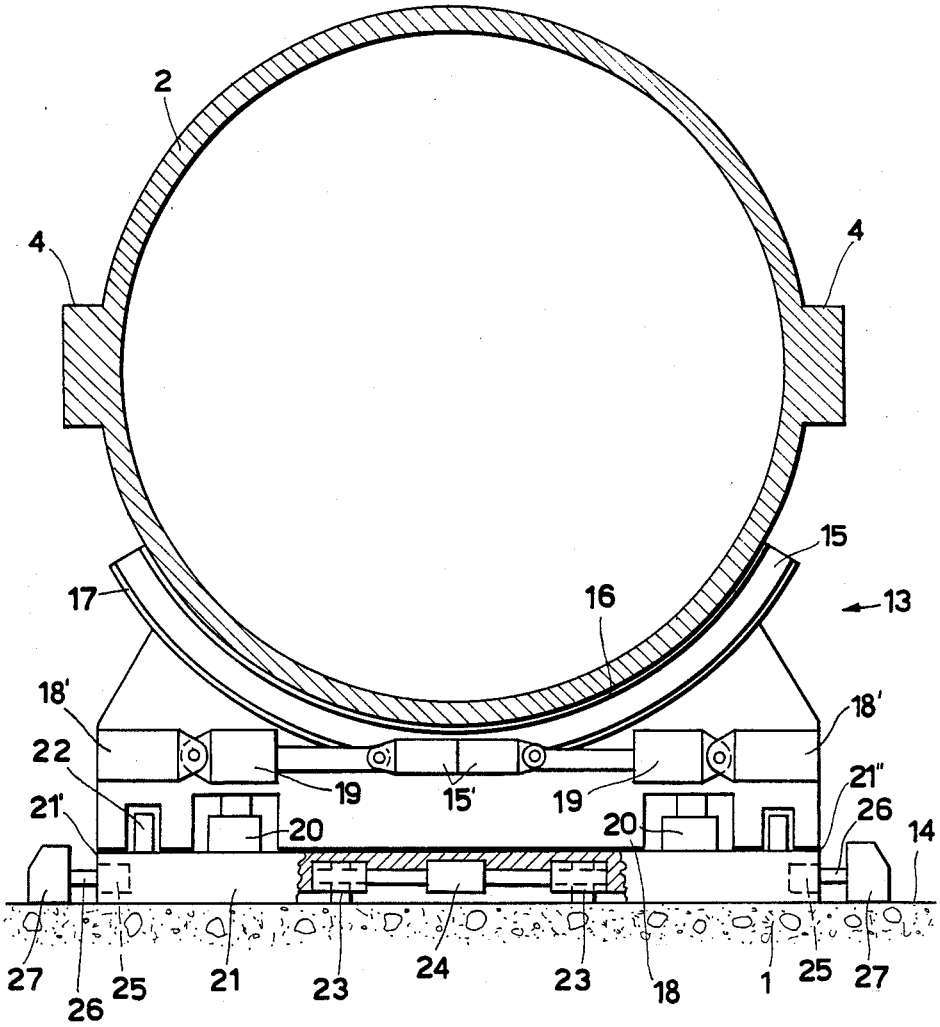
FIG. 8 shows a transversal, viz. frontal, partially sectional view, on an enlarged scale, of the support saddle adjustable in position, realized according to the invention.

The basin 1 is provided with an upper door 12 equipped with water-tight seals. The basin is flooded, when an upper door 12 is opened (see FIG. 3), and a prefabricated module 2 enters the basin. Then, by emptying the basin 1 by means of pumps, and the door 12 being kept hermetically closed (see also FIG. 4), the module 2 is made to lie on the two support saddles 13 provided on the bed 14 of the basin 1. Each support saddle 13 is comprises an upper structure 15 having the shape of a support saddle, on whose upper rubber-coated surface 16, said module 2 lays upon. The lower, concave surface 17 of the upper structure 15 (see FIG. 8) is, on the contrary made, of Teflon, in order to be able to circumferentially slide along a corresponding transversal saddle-outline provided on the upper end of an intermediate structure 18. It is driven by means of hydraulic cylinders 19 respectively hinged between jutting out blocks 18' of the intermediate structure 18 and jutting out blocks 15' of the upper structure 15.

Said intermediate structure 18 is then supported, but able to move vertically by means of four hydraulic adjustment cylinders 20. A base 21 is provided with pins 22 acting as guides for the vertical displacement of said intermediate structure 18, as well as with wheels 23 driven by a ratiomotor 24, for the axial movement of the same base, and hence of the whole support saddle 13. The base 21 is also movable in the transversal direction, by being driven by means of hydraulic adjustment cylinders 25 fastened to the side walls 21' and 21'' of the base, the pistons 26 of said cylinders 25 cooperating with the rigid shoulder and guide structures 27 which is fastened to the bed 14 of the basin 1.

Figure 2:
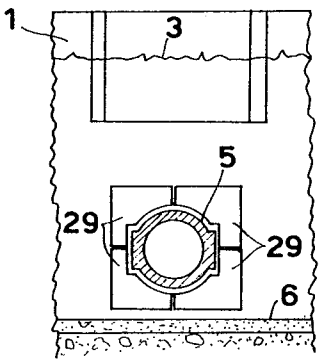
FIG. 2 shows a partial, front or transversal view of the basin of FIG. 1.
Figure 1:
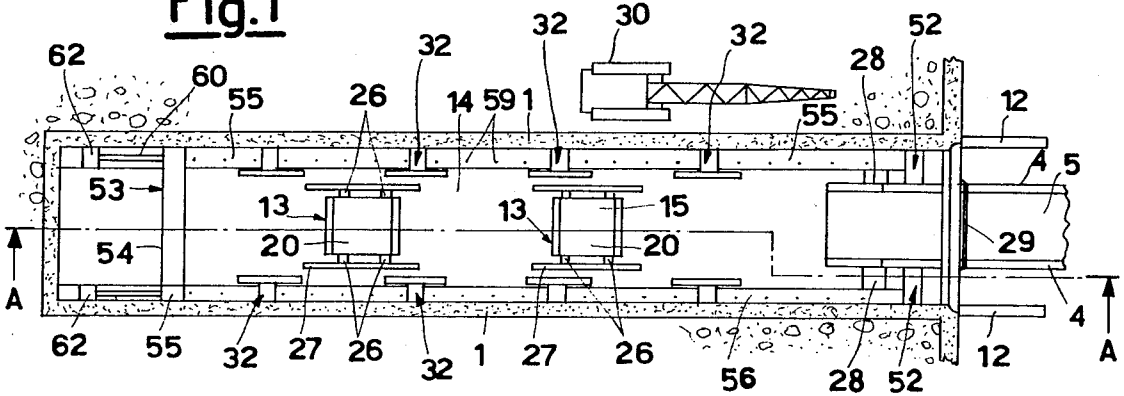
FIG. 1 shows a top view of the floodable assemblage basin, equipped for practicing the process according to the invention.
Figure 5:
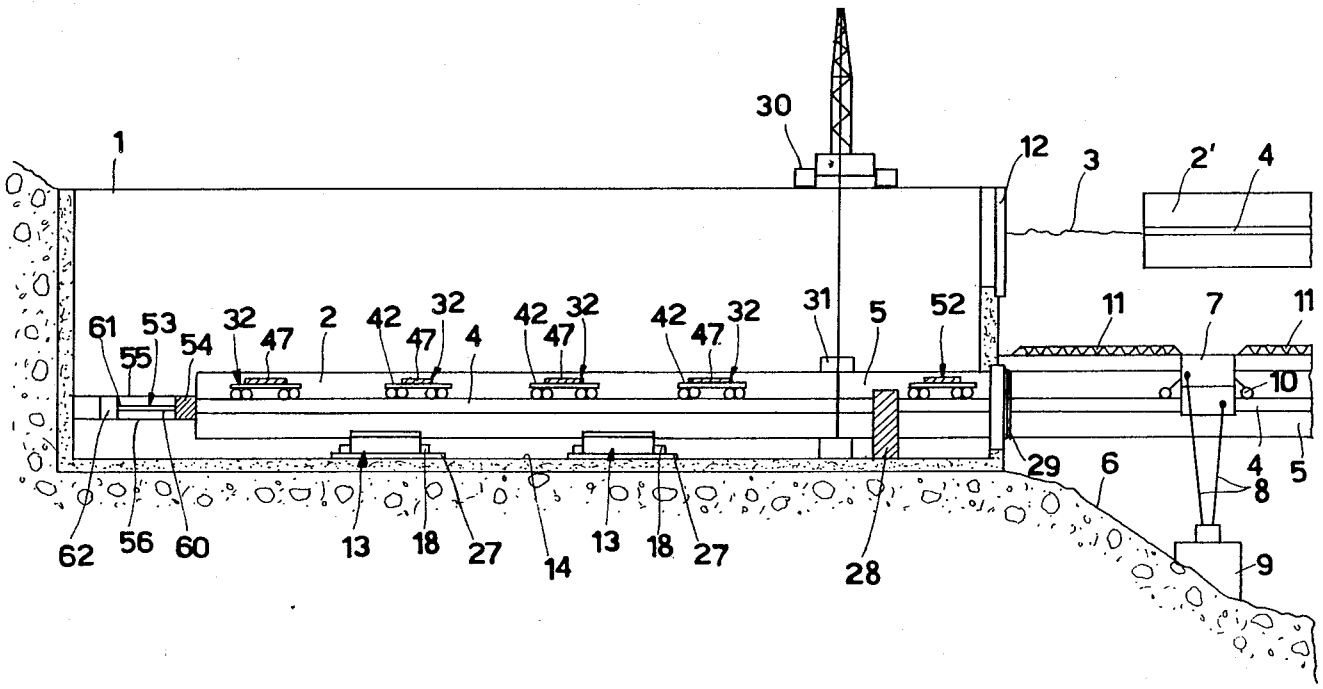

. Then, by acting on the hydraulic cylinders of the support saddles 13 which makes possible the module 2 to be adjusted in the vertical direction, in the axial and transversal direction, and in the circumferential direction, said module 2 is lined up, and butt-approached to the already installed connection length 5 (see FIG. 5). This length is kept in its position by a temporarily-blocking apparatus 28, and protrudes outside the basin 1 through a lower, water-tight-closed door 29 (in FIG. 2, said door is represented by four movable sectors of photographic-diaphragm type).

After that the welding, check and cementation station 31 is lowered by means of a crane 30 to the bed 14 of the basin 1 (see still FIG. 5), the module 2 is then butt-connected to the already launched length of connection 5 and then, after that by means of the above said crane 30 said station 31 is is lifted again. Then, the thrust roller units 32 which are provided in the basin 1 are overturned, until they get blocked above said wings 4 of the prefabricated module 2, and the same basin is flooded.

Figure 9:
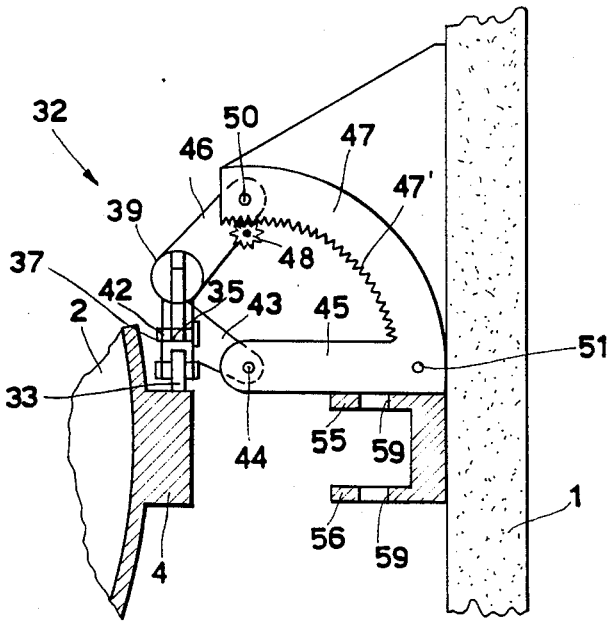
FIG. 9 shows a transversal, viz. frontal view, on an enlarged scale, of the overturnable thrust roller unit realized according to the invention.
Figure 10:
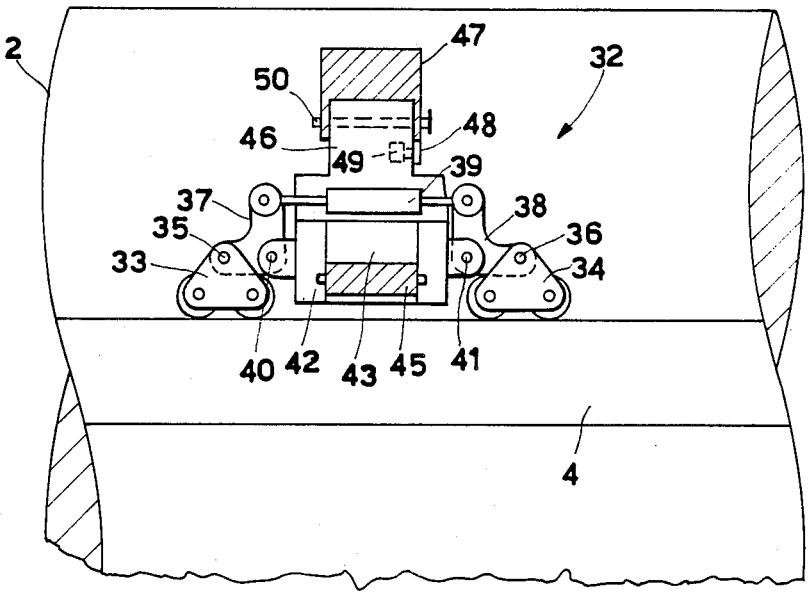
FIG. 10 shows a longitudinal, viz. axial, view of the roller unit of FIG. 9.

Each overturnable thrust roller unit 32 comprises (see specifically FIGS. 9 and 10) two small cars 33 and 34 which are respectively hinged in 35 and 36 to an end of two "L"-shaped levers 37 and 38, the other ends of which are linked to each other by a hydraulic thrust cylinder 39, which performs the function of elastically compressing the cars on the wings 4, so as to compensate for possible unevennesses of such wings. The levers 37 and 38 are respectively hinged in 40 and 41 to the faces of a bearing structure 42, which are, mutually opposite in the axial direction (see FIG. 10), from which an "L"-shaped structure protrudes in the transversal direction (see FIG. 9). The lower branch 43 of this structure is hinged 44 to a support 45 integral with the wall of the basin 1, so as to make possible the whole roller unit 32 to revolve to perform the overturning movements. The other branch 46 of the above said "L"-shaped structure, on the contrary, enters, with its free end, the "U"-shaped cross section of a body having a circle-arc shape 47, which is positioned transversely to, and is made integral with, the wall of the basin 1. The body has a rack 47' with which a gearwheel 48 inmeshes, which is rotatably mounted on said branch 46, and is driven by a small motor 49, also supported by the branch 46. Thus, the action by the motor 49 makes the roller unit 32 revolve around the pivot 44 from its working position, wherein it is blocked by means of the pin 50, to its retracted position, wherein it can be blocked by a pin 51, and vice-versa.

In the Figures, a couple of fixed roller units 52 are also shown, which act on the launched length of practicable connection 5.

Figure 6:
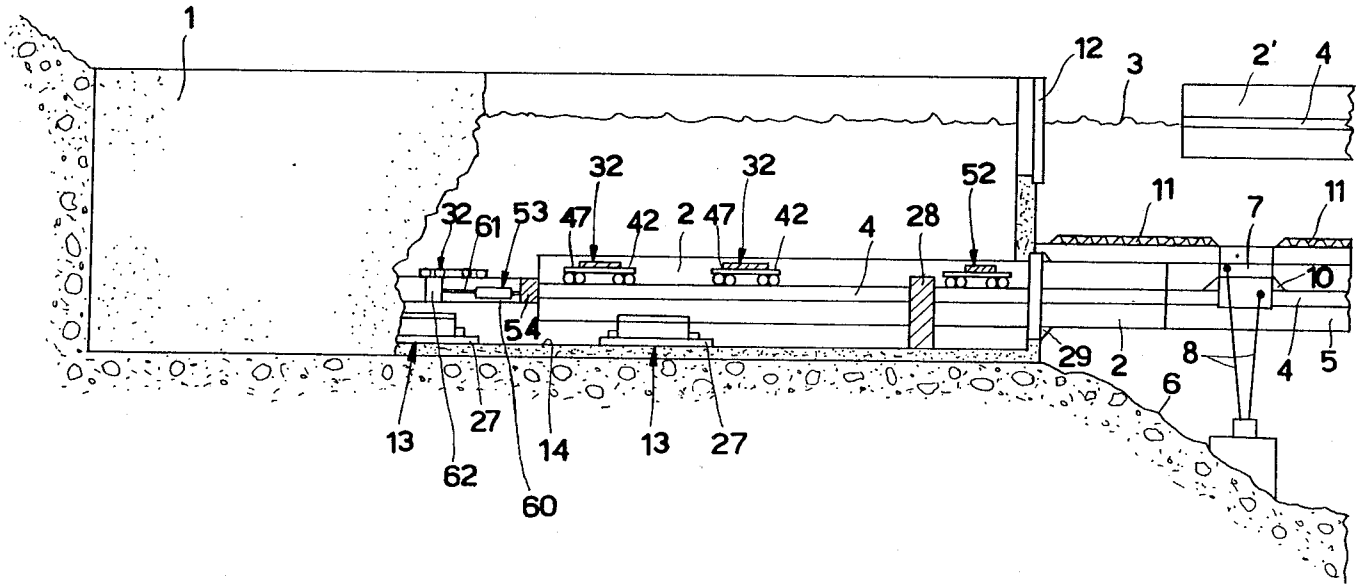

Once the basin 1 is completely flooded, the temporarily-blocking apparatus 28 is disengaged, the lower, water-tight sealed door 29 is opened (see FIG. 6), and the module 2 is launched, guided by said thrust roller units 32, and pushed by the driving system 53.

The driving system 53 comprises a transversal thrust beam 54 (see specifically FIGS. 11 through 13) which, by transversely crossing the basin 1, has its ends inserted between two mutually opposite wings 55 and 56 of two longitudinal double-"L"-shaped guide beams 57 and 58, which are provided with equidistant and mutually opposite holes 59, which run throughout the length of the basin 1.

Each of said ends of the thrust beam 54 is then connected with hydraulic, double-effect, hydraulic thrust cylinders 60 (two of which are visible in the Figures). The pistons 61 of the cylinders 60 are linked with a block 62 equipped with two vertical and mutually opposite hydraulic jacks 63 and 64 (see FIG. 12), suitable for inserting the two teeth 65 and 66 into said mutually opposite holes 59 of the wing 55 and the wing 56 of the guide beams 57 and 58 respectively.

In this way, by inserting the teeth 65 and 66 into the holes 59, so as to fix the blocks 62 in position, and by extracting the pistons from the hydraulic thrust cylinders 60, the thrust beam 54, and consequently the module 2, are displaced forwards; then, by disconnecting the blocks 2 and retracting the pistons, the system is returned back to the position for carrying out a subsequent displacement, with the teeth 65 and 66 being inserted inside the subsequent holes.

Figure 7:
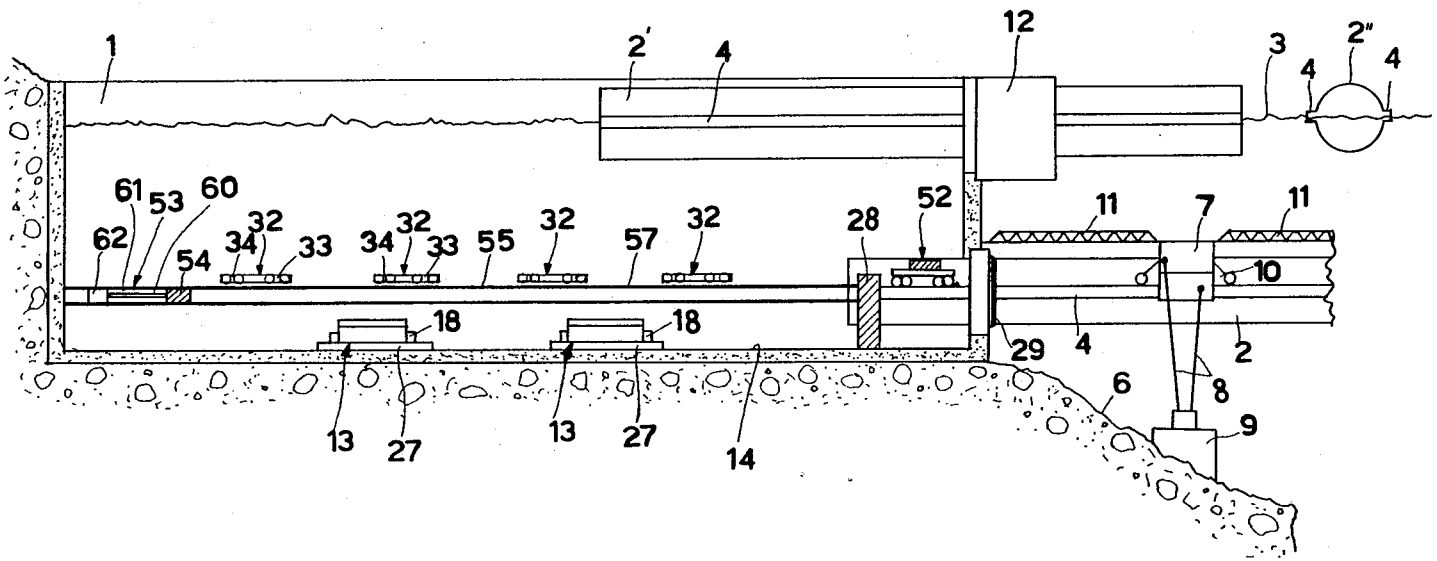

After launching the prefabricated module 2, the lower, water-tight sealed door 29 is closed again, the temporarily-blocking apparatus 28 is engaged again, the driving system 53 (see FIG. 7) and the support saddles 13 are returned back to their initial positions, the thrust roller units 32 are overturned, the upper door 12 is opened again and the cycle is repeated, by introducing into the basin a further freely-floating module 2'. The cycle is considered finished when the installed length of practicable connection by means of the coupling and launching, reaches the bank opposite to the bank wherein the assemblage basin is situated.

We claim:

1. A method of making an underwater crossing using prefabricated modules which are sequentially butt-connected in a floodable assemblage basin until the bank opposite that of the assemblage basin is reached, comprising:

(a) introducing a module into the floodable basin from a standby area adjacent to the basin through an upper door wherein the modules are freely floating and include side wings;

(b) emptying the floodable basin so that the module comes to rest on adjustable support saddle means which are located on the bed of the basin wherein said saddle means are adjustable in the vertical, axial, transverse, and circumferential direction;

(c) aligning the module with a length of an already launched and installed module wherein said launched and installed module is located within a lower waterproof door means and is kept in position by a temporary blocking apparatus means located within the basin;

(d) lowering into the basin a welding, check, and cementation station by means of a lowering device in order to make said butt-connection of the module with said launched and installed module;

(e) relifting and removing said welding, check, and cementation station from the basin by means of said lowering device;

(f) rotating and overturning thrust roller unit means which are attached to the walls of the basin and which rest upon said side wings of the module;

(g) reflooding the basin and disengaging said temporary blocking apparatus means from said lauched and installed module;

(h) opening said lower water-tight door means and lauching the module, which is now butt-connected to said already launched module, by pushing by means of a driving system means located within the basin and guided by means of said thrust roller means; and (i) retracting said driving system means and said support saddle means back to their respective initial positions, re-engaging said temporary blocking apparatus means re-closing said lower water-tight door means, retracting said thrust roller unit means back to their initial positions, and re-opening said upper basin door means for introducing a next prefabricated module.

2. The method of claim 1 further includes the step of providing at least two of said adjustable support saddles.

3. An apparatus for making an underwater crossing using prefabricated modules which are sequentially butt-connected in a floodable assemblage basin until the bank opposite that of the assemblage basin is reached, comprising:

an adjustable support saddle on which the module comes to rest when the floodable basin is emptied, wherein said adjustable support saddle is positioned on the bed of the basin, and wherein said adjustable support saddle includes:

(a) a base axially moveable on the bed of the basin;

(b) wheels for moving said base;

(c) a ratiomotor for driving the saddles;

(d) hydraulic adjustment cylinders fastened to the sides of said base wherein pistons of said cylinders operate against rigid shoulders and guide structures fastened on the bed of the basin;

(e) vertically adjustable hydraulic cylinders attached to and supported by said base;

(f) a curvilinear structure positioned above said base having a fixed portion which is attached to said floodable assemblage and a movable portion which is circumferentially movable upon the surface of said fixed portion and wherein said movable portion is adapted to support the prefabricated module; and (g) hydraulic cylinders hinged to said curvilinear structure for causing the circumferential movement of said movable potion.

4. The apparatus of claim 3 wherein the modules have sidewings, and wherein the apparatus further includes rotating and overturning thrust roller units which rest upon said wings and which are attached to the walls of the basin, wherein said thrust rollers include:

(a) a bearing structure;

(b) two L-shaped levers hinged at their middle to said bearing structure, axially opposite each other;

(c) at least two cars each hinged on one arm of each of said L-shaped levers;

(d) hydraulic thrust cylinders linking the other arms of said L-shaped levers and hinged thereto;

(e) an L-shaped member attached to said bearing structure which protrudes in the transverse direction and the lower branch of which is hinged to a support integral with the wall of the floodable basin;

(f) a gearwheel mounted on the other branch of said L-shaped member to revolve the entire roller unit means in the transverse direction from a retracted position to a working position;

(g) a motor attached and supported by said other branch;

(h) a semi-circular rack in which the gear wheel meshes and wherein said rack is transversely positioned and integral with the wall of the floodable basin; and (i) a pin inserted between said other branch of the L-shaped member and said rack to block the thrust roller unit means in either said working position or in said retracted position.

5. The apparatus of claim 3 further including a driving system located in the basin for driving the module which is butt-connected to an already launched module out of the assemblage basin, wherein said driving system comprises:

(a) a transversal thrust beam;

(b) two longitudinal double-L shaped guide beams having mutually opposite wings into which the ends of said transversal thrust beam slidingly enters and wherein said double L-shaped guide beams have mutually opposite bores which run the length of the entire floodable basin;

(c) at least one hydraulic double acting thrust cylinder connected to the end of said transversal thrust beam; and (d) a block having two mutually opposite vertical jacks, wherein said block is linked to the piston of said hydraulic cylinder and said jacks have teeth for insertion into said bores of said mutually opposite wings of said longitudinal guide beams.

* * * * *